US005402855A

United States Patent [19]

Gondouin

[11] Patent Number: 5,402,855

[45] Date of Patent: Apr. 4, 1995

[54] COILED TUBING TOOLS FOR JET DRILLING OF DEVIATED WELLS

[75] Inventor: Michel Gondouin, San Rafael, Calif.

[73] Assignee: S-Cal Research Corp., San Rafael, Calif.

[21] Appl. No.: 29,391

[22] Filed: Mar. 10, 1993

[51] Int. Cl.[6] ..... E21B 7/26

[52] U.S. Cl. ..... 175/21; 175/45; 175/424

[58] Field of Search ..... 175/21, 45, 424, 393

[56] References Cited

U.S. PATENT DOCUMENTS 4,930,586 6/1990 Turin et al. ..... 175/45 X 5,111,891 5/1992 Kinnan ..... 175/45 X

*Primary Examiner*—William P. Neuder

[57] ABSTRACT

Low-cost, medium-curvature, deviated drainholes are drilled from a vertical cased well in soft formations, using the jet-drilling technique with a coiled-tubing. The high-velocity liquid jet is oriented at a small angle from the axis of the coiled tubing in the selected direction. The jet nozzle assembly is held by a pin in a reference groove in the tubing wall, parallel to its axis. A similar pin in a conventional sonde containing orientation sensors is also inserted in the same groove, so that the jet's spatial orientation is fully determined, with respect to the vertical and North. The jet angle with respect to the tubing axis is pre-set by mechanical or hydraulic locking devices and periodically re-adjusted, based on the sonde's spatial orientation data.

The jet nozzle angle may be re-adjusted at the surface after wireline retrieval of the nozzle assembly, or the adjustment may be done downhole by running-in suitable wireline tools, whose pins replace that of the sonde in the reference groove, and whose actuators connect with the mechanical or hydraulic devices. The jet nozzle may also be automatically adjusted downhole by a servo-system utilizing as input the sonde sensors data. The nozzle head surface is a portion of a sphere, pivoting in a hemi-spherical dome cavity at the tubing end.

The high velocity jet, when loaded with abrasive particles, may also be used to cut windows into the vertical casing. The combined use of this orientable jet-drilling nozzle with a coiled tubing and with multiple whipstocks described in application Ser. No. 07/814,585, results in additional savings.

22 Claims, 13 Drawing Sheets

COILED TUBING TOOLS FOR JET DRILLING OF DEVIATED WELLS

FIELD OF THE INVENTION

Jet drilling with conventional rock bits in which one of the nozzles for mud circulation has been enlarged has been used for many decades to kick-off a borehole into a deviated direction, or to correct an unwanted deviation from the vertical while drilling a well with a rotary drilling rig, using a conventional drill string.

More recently, it has been shown that drilling highly deviated or horizontal drainholes of small diameter could be done more economically using a coiled tubing instead of a conventional drilling string made up of drill pipe elements connected to each other by threaded joints. The main economic advantage of the coiled tubing is that it is continuously fed into the borehole, without interruption of the drilling process for adding a new drill pipe each time the hole has been deepened of the corresponding length of such a drill pipe element (commonly about 30 ft). Such interruptions become very frequent when drilling in soft formations, where the borehole length equal to that of one such element may be drilled in much less than one hour. The drilling cost, which is largely controlled by the rig time required, is markedly increased by such frequent interruptions of the drilling process. One improvement has been to use drilling rigs equipped with taller derricks and capable of handling longer elements of drill pipe, for instance double elements (60 ft long), but this type of rig is also more expensive, so that cost savings are smaller in proportion than the rig time savings achieved by this improvement.

The use of a continuously-fed coiled tubing as a drill pipe totally eliminates the drill string make-up time. Furthermore, it also eliminates the need for a drilling derrick, thus greatly reducing the rig hourly cost.

A technical limitation of the coiled tubing, however, is that it cannot withstand many cycles of coiling and uncoiling before failing by fatigue cracks in the tubing metal.

Jet drilling with coiled tubing has been used to drill drainholes presenting an ultra-short radius of curvature ($R=<10$ ft). The whipstock used to bend the coiled tubing into such a sharp curve applies stresses in the metal of the tubing which exceed its elastic limit. This further reduces the possibility of moving the coiled tubing in and out of the hole without severe mechanical damage to the tubing. The technical feasibility of jet drilling and completing multiple horizontal drainholes in the unconsolidated Heavy Oil sands of California by this technique and their subsequent operation as part of a radial cyclic steam injection well have been demonstrated. The horizontal reach achievable by this technique is, however, limited to about 150 ft and the directional control of the drainholes bearing is somewhat limited. The use of the reaction forces from lateral jets to control the orientation of the jet drilling nozzle may also result in very large hole wash-outs in some soft formstions.

It is a general observation that maintaining hole stability when drilling horizontal or deviated wells in unconsolidated sands and avoiding future sand production problems can be achieved more easily if drilling proceeds with minimum interruptions and with minimum in-and-out movement of the drill string. Gravel-packing of the liner is also more effective in the absence of any large wash-outs and/or dog-legs in the hole. A steady rate of penetration, with continuous mud circulation and few changes in borehole fluid pressure are also instrumental in achieving these goals.

High pressure jets of liquids loaded with abrasive particles are also commonly used for "in situ" cutting or perforating oil well tubings and casings. These operations are generally done using tools equipped with fixed nozzles, fastened to the end of the drill string of a rotary drilling rig. These tools, however, cannot cut lateral windows of precise shape and dimensions in well casings.

SUMMARY OF THE INVENTION

The object of the invention is to drill medium-curvature ($R>=200$ ft) drainholes of medium (300 to 800 ft) horizontal reach by jet drilling with coiled tubing, at a lower cost, while providing a better bearing control of each drainholes. These objectives are achieved by using wireline-retrievable jet nozzles which are oriented with respect to a groove in the inner surface of the coiled tubing, by means of a pin. The spatial orientation of that reference groove is in turn measured by a wireline-retrievable sonde including, for instance, a compass and an accelerometer. Such sondes, operated at the end of an electric cable, are commercially available. Their small diameter, compared to the inside diameter of the tubing, allows the flow of mud through the annulus to the drilling assembly below.

The bearing and inclination of the sonde are used to determine the successive orientations of the jet nozzle which are required to obtain the desired angle build-up and bearing of the drainhole. The larger radius of curvature of the coiled tubing reduces drag. This allows to achieve a longer horizontal reach and leaves the possibility of some in-and-out movement of the coiled tubing to facilitate its re-orientation, with minimal mechanical damage. As taught in patent application Ser. No. 814,585, it is advantageous that the coiled tubing remains in the horizontal hole after it has reached its targeted depth to serve as a permanent liner which is cemented in its upper curved part and subsequently slotted in its horizontal part, using the slot-cutting tool described in said Patent Application. This last operation is preferably done after gravel-packing the annular space around the tubing, so as to prevent reservoir sand from being later carried into the liner, well production tubing and pump by the produced fluids. After reaching the targeted depth and prior to these well completion operations, the orientation sonde and the jet nozzle directional controls are retrieved to the surface, thus minimizing the value of the drilling tools abandoned in the drainhole.

In all embodiments of the invention, the data transmitted or recorded by the orientation sonde are used to periodically adjust the jet-drilling nozzle orientation so that the drainhole follows the prescribed course.

In the first embodiment, the assembly is connected to an ombilical, electric or fiber optic cable, slick-line or hydraulic line by a preferred shroud, equipped with a guiding pin and latches of the known wet connector type used to pull-out the sonde and jet nozzle assembly to the surface, where appropriate part replacements or adjustments are made, based on sonde data, in the orientation of the nozzle with respect to the reference pin, which fits into the reference groove of the coiled tubing.

In another embodiment, only the orientation sonde is periodically pulled-out and a wireline tool is then run-in to change the orientation of the nozzle downhole, in accordance with calculations made from the sonde data. In this case, drilling continues during the wireline work with drilling fluid flowing through the annulus around the sonde, thus resulting in much shorter interruptions of the coiled tubing penetration.

In yet another embodiment, the nozzle assembly includes a motorized device to re-orient the nozzle downhole as a function of the data provided by the orientation sonde, thus reducing the number of required wireline operations only to those for repairs and for pulling-out the motorized nozzle assembly and orientation sonde when the drilling target has been reached and the drainhole liner completion begins. The computing element in this feed-back loop may be located at the surface or downhole. With this system, nearly continuous penetration is possible.

The same type of orientable nozzle, retrievable by wireline may also be used for abrasive cutting of lateral windows of elliptical shape in well casings, through which a coiled tubing or drill string may be inserted at a small kick-off angle to begin the drilling and completion of a deviated or horizontal drainhole, the upper part of which may later be cemented to make a leak-tight branch connection with the vertical casing.

The benefits derived from these improvements are: wells equipped with more productive drainholes, at a lower cost, in soft formations where maintaining hole stability during drilling and avoiding sand production problems are major technical requirements, especially for wells intended for operation under cyclic steam injection.

DETAILED DESCRIPTION

Figure 4:
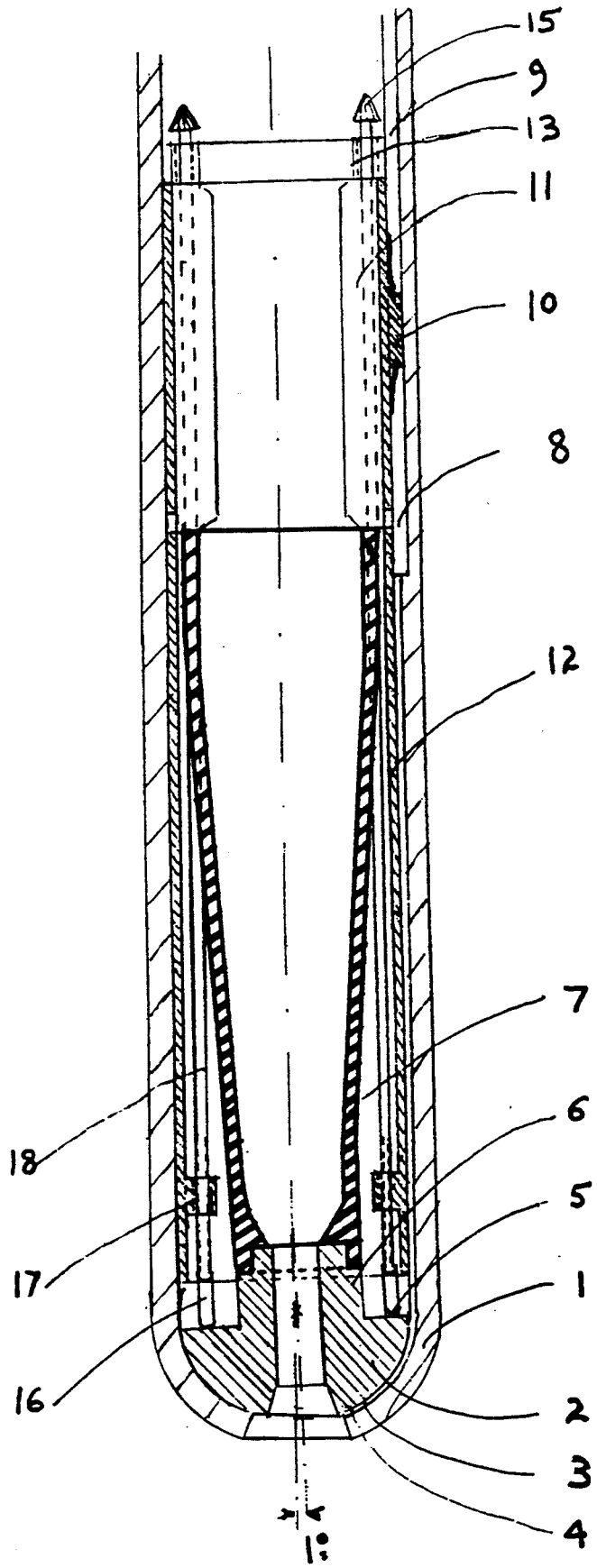
FIG. 4 is a longitudinal cross section of a nozzle head guided by three pusher rods and adjustable screws
Figure 6:
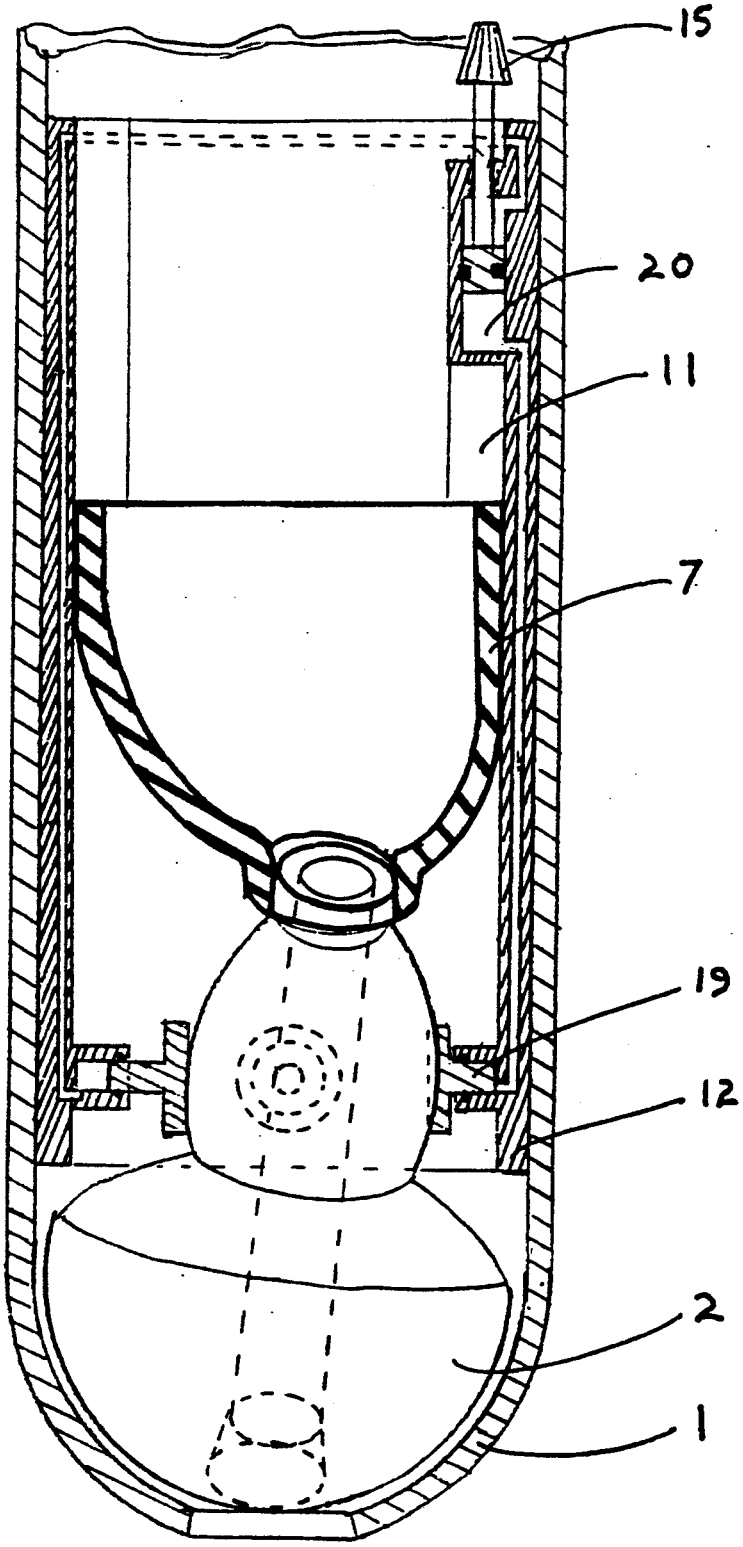
FIG. 6 is a longitudinal cross section of a nozzle head guided by four hydraulic pistons.
Figure 8:
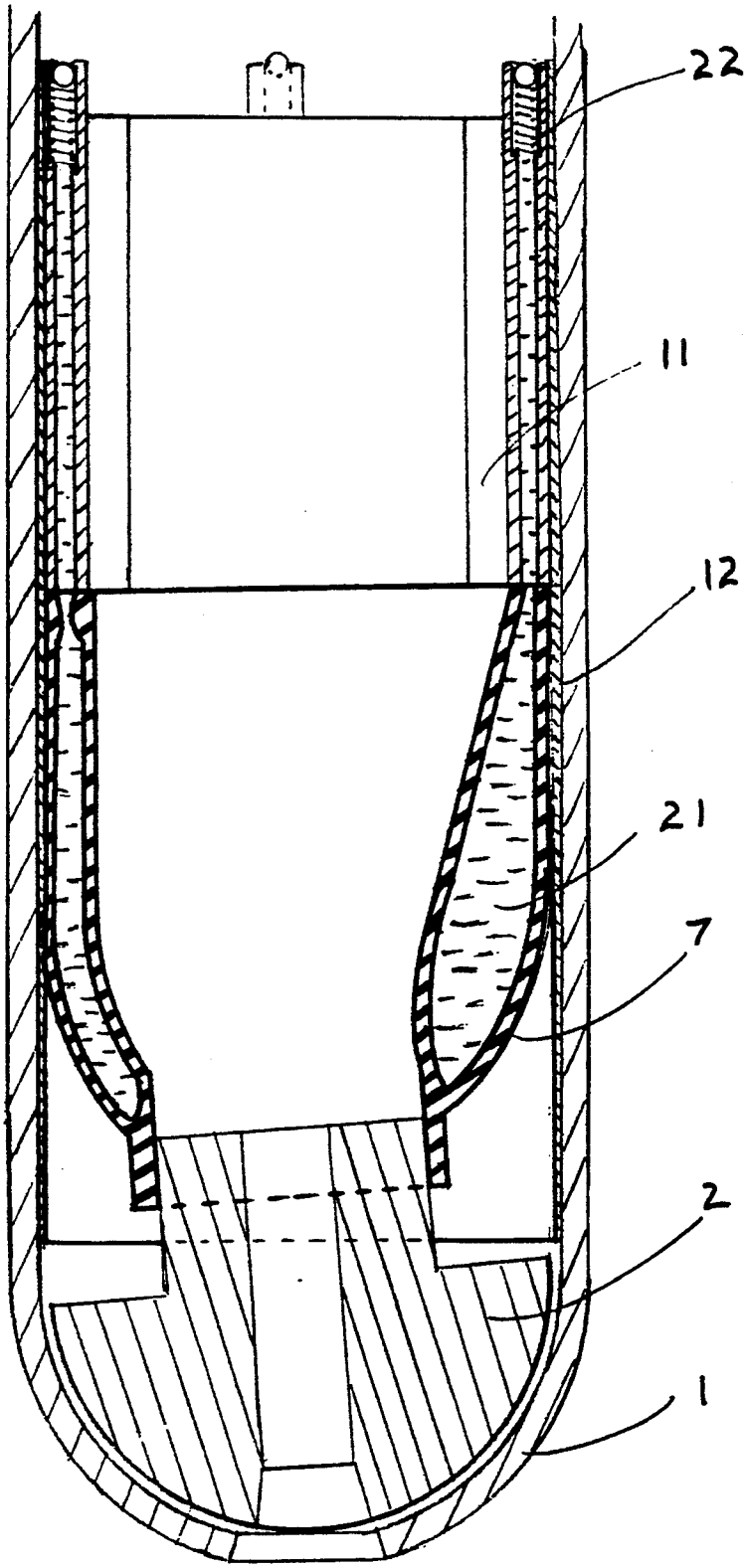
FIG. 8 is a longitudinal cross section of a nozzle head guided by four inflatable hydraulic bladders.

In all cases considered, the drilling head (1) is equipped with an orientable nozzle (2) terminated by an end surface (3), which is a significant portion of a sphere, say, for instance, hemi-spherical and firmly applied against a matching inner hemi-spherical dome (4) of the tubing end, as in FIG. 4. or two perpendicular sets of forces applied on the surface of revolution of the nozzle tail (6) as in FIG. 6, or a set of four torques applied upon the edge of the nozzle tail (6) by the attached deformable skirt (7), preferably made of elastomeric material in FIG. 8. These forces or torques must balance the lateral forces due to the deviation of the nozzle jet with respect to the axis of the drilling head, plus all friction forces.

The adjustment of these forces, may be by mechanical means, as illustrated in FIG. 4, or by hydraulic means as in FIGS. 6 and 8, in which cases, the hydraulic pressures may be produced by various means (two positive displacement piston pumps, as in FIG. 6, or four gas-pressurized liquid chambers, as in FIG. 8. Those skilled in the art will recognize that these are only examples of many possible configurations based on the same principles and that the exact portion of the spherical contact required to provide this sort of knuckle joint is dependent upon the materials selected, the tubing diameter and the magnitude of the maximum jet angle deviation (a few degrees at most).

The energy required to create these forces may be provided by electric or hydraulic devices. Its source may be downhole in the form of batteries or gas cylinders, or transferred from the surface via an electric cable or via a hydraulic line. Finally, if the entire nozzle assembly is brought to the surface for adjustment of the nozzle orientation, at atmospheric pressure, there is no need for such transfers of energy from the surface downhole.

Figure 1:
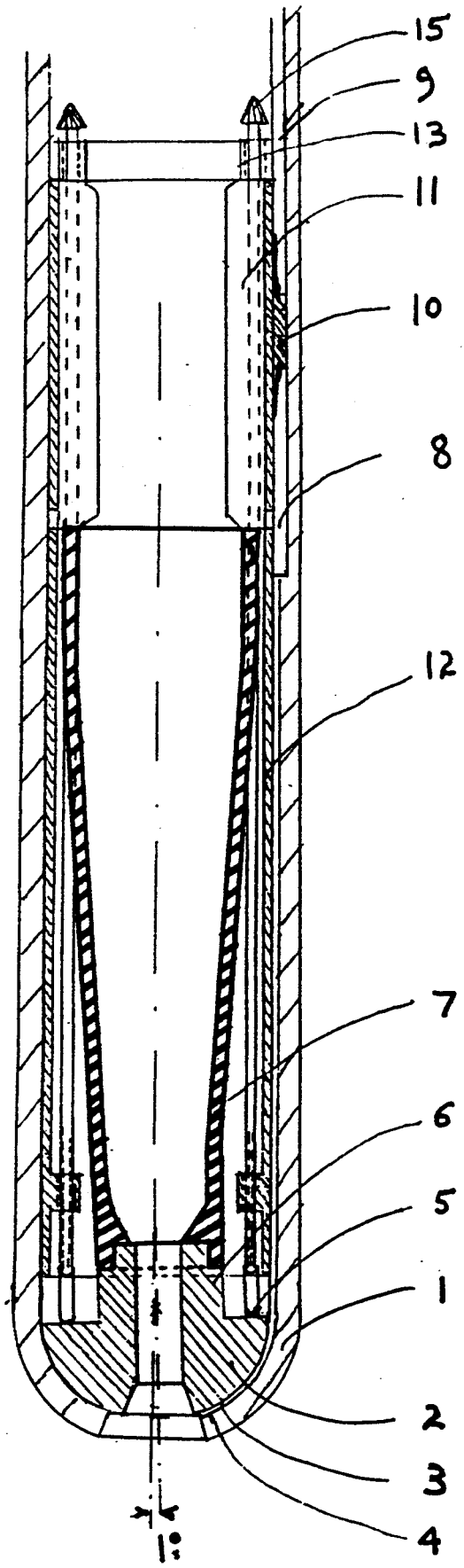
FIG. 1 is a longitudinal cross section of the drilling head of the coiled tubing, with the retrievable nozzle assembly and orientation sonde inserted in the same orientation groove.
Figure 2:
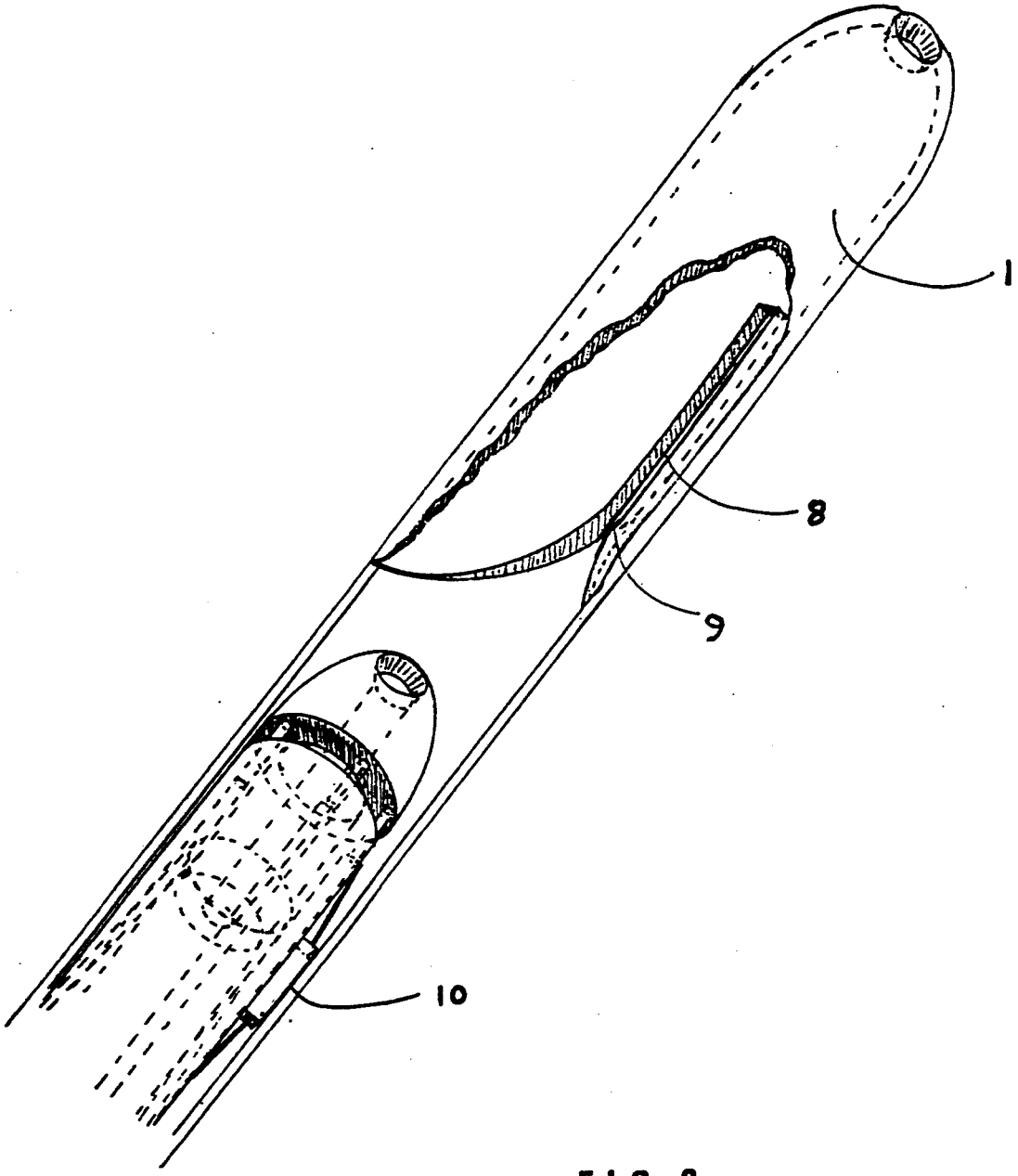
FIG. 2 is a perspective view of the orientation groove in the coiled tubing head.

FIG. 1 shows the orientation reference groove (8) cut parallel to the axis of the drilling head, into its inner wall. Its upper end is connected to a guiding recess (9), in which the spring-loaded reference pin (10), carried by the nozzle assembly takes its extended position and enters into the groove 8, as shown on FIG. 2.

Figure 3:
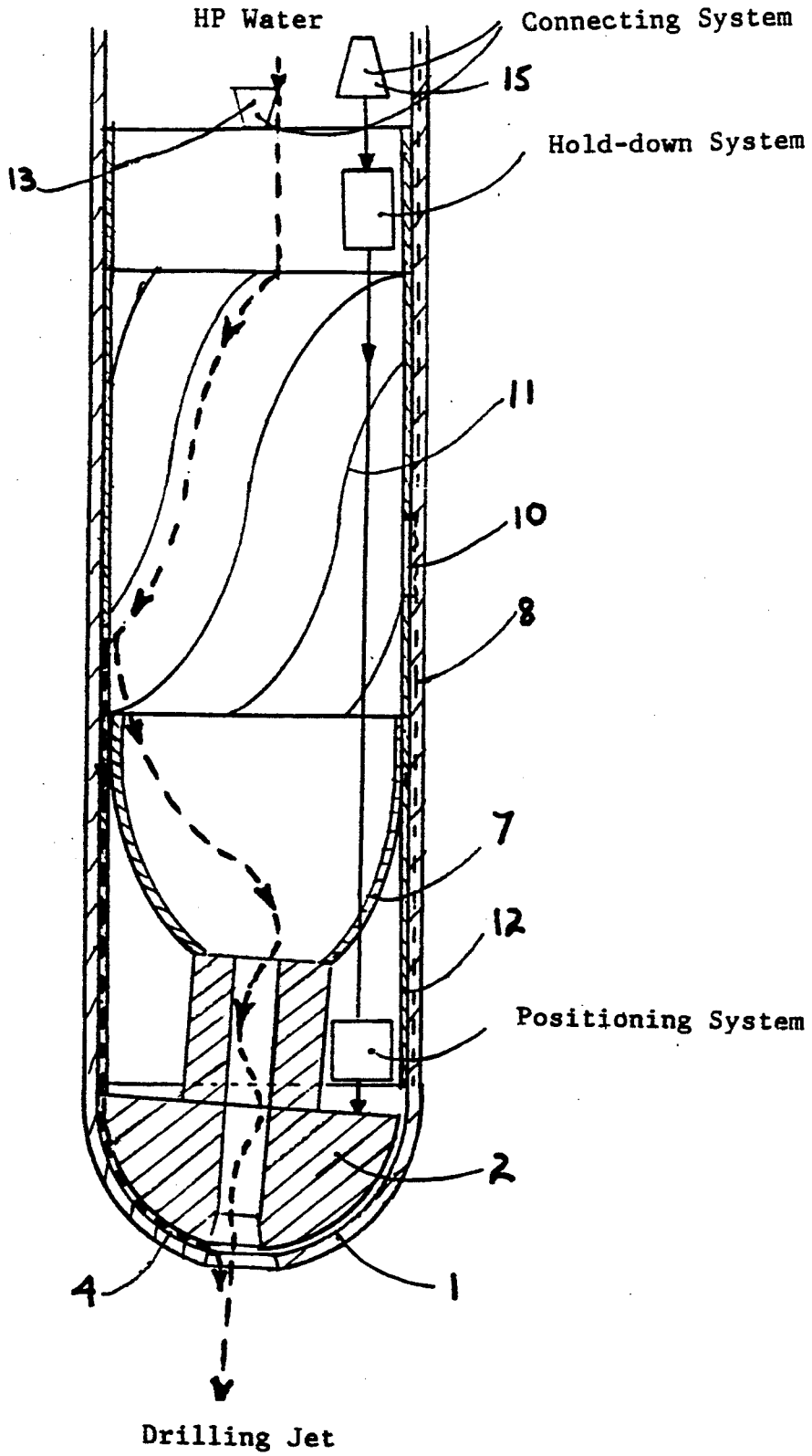
FIG. 3 is a block diagram of the nozzle assembly showing its main functional elements.

FIG. 3 shows the main components of the nozzle assembly: the nozzle head, at the lower end, including the nozzle (2) itself, its positioning system (Mechanical, or hydraulic), its hold-down system (screws or check-valves which maintains the position of the nozzle (2) unchanged regardless of variations in the water jet pressure, and the skirt (7) which is bell-shaped, with its lower end attached to the nozzle tail and therefore mobile, while its upper end is attached to the vanes unit (11) in which the retractable pin (10) is housed. The nozzle housing (12) is also attached to the lower end of the vanes unit. It covers the positioning system which closely fits into the tubing drilling head. Shallow grooves into the nozzle housing carry the water slip stream from entry points in the lower part of the vanes unit to the grooves cut into the dome (4) of the drilling head. The close fit of the nozzle housing and the extended pin (10) into the reference groove provide a fixed orientation for the axial connector (13) into which the nose of the orientation sonde, not shown, is inserted. The sonde is also equipped on its upper end with a retractable reference pin which is also inserted into the reference groove. This insures that the frame of reference for instruments (compass and accelerometers) in the sonde is effectively that of the groove (8), which is an integral part of the drilling head and the same as that of the nozzle assembly. Also placed on the upper part of the vanes unit, preferably along its periphery, are the connectors (15) (mechanical, hydraulic or electric), which transfer forces to the positioning system from a wireline orientation tool (case of FIG. 12) or from a servo-system (case of FIG. 13).

FIG. 4 shows a nozzle head in which the positioning system consists of three pusher rods (16), parallel to the axis of the nozzle assembly. The lower end of each rod presses against the diametrical plane (5) of the nozzle end. The rods slide in three grooves cut into the nozzle housing. The upper end of each rod is actuated by the lower end of a non-reversible screw extending all the way to the upper part of the vanes unit and terminated by a conical gear connector (15). Each screw goes through a threaded guide which is an integral part of the nozzle housing. Rotation of the gear (15) in one direction advances the screw (18) into its threaded nut (17), which is part of the nozzle assembly, and pushes the corresponding rod (16) downwards, thus tilting the nozzle in the opposite direction, if the other two screws have previously been reversed away from the plane (5) to allow its tilting. Each of the positioning screws is thus sequentially actuated to provide the desired orientation of plane (5), and consequently of the nozzle axis. To control the operation, the drivers of the screws are equipped with counters used to control their rotation to a pre-set number of turns in the prescribed direction. The fact that each screw is non-reversible provides the hold-down mechanism required to prevent any flutter of the nozzle when water pressure varies. It will be apparent to those skilled in the art that other hold-down devices besides the non-reversibility of the three screws may also be used without departing from the spirit of the invention. The skirt (7) is attached to the nozzle tail but its upper edge may be free. It is then deformed more easily by the pressure distribution of water in this curved channel.

Figure 5:
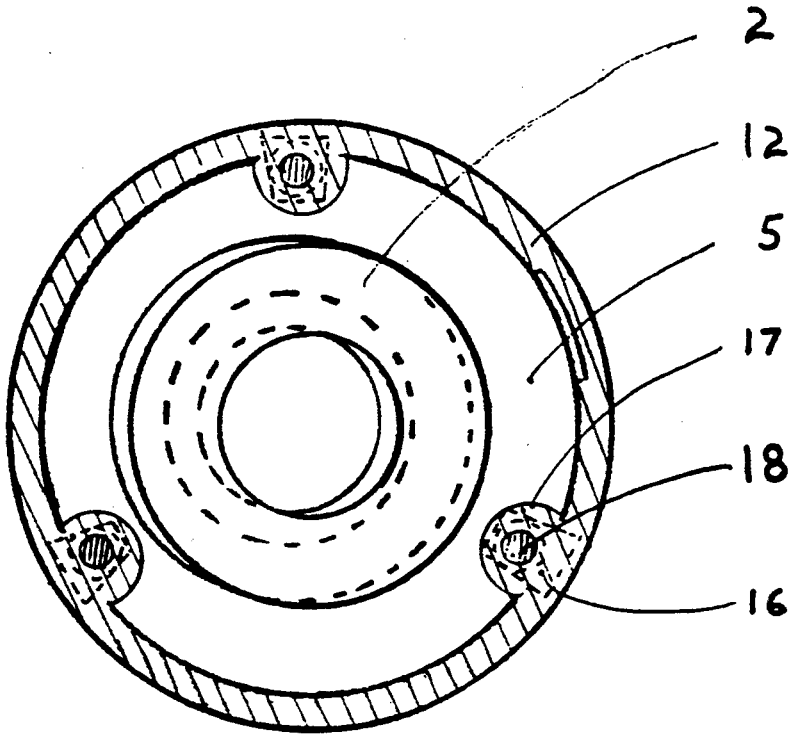
FIG. 5 is a transversal cross section of the nozzle head of FIG. 4.

FIG. 5 shows the relative location of the three pusher rods along the periphery of the nozzle housing.

In FIG. 6 four hydraulic pistons (19) disposed radially in two perpendicular directions press against the nozzle tail, thus rotating the nozzle. Each pair of opposing pistons may be connected to a twin-cylinder positive-displacement pump (20), so that while one of the pistons advances, the other is backing-up. The shape of the nozzle tail is then that of a solid of revolution generated by a curve of constant width (i.e. for which parallel tangents are separated by a constant distance).

An obvious example of such a type of curve is the circle, but there are also some other curves (epicycloids for instance), which satisfy this condition over a curved segment of sufficient length.

Figure 7:
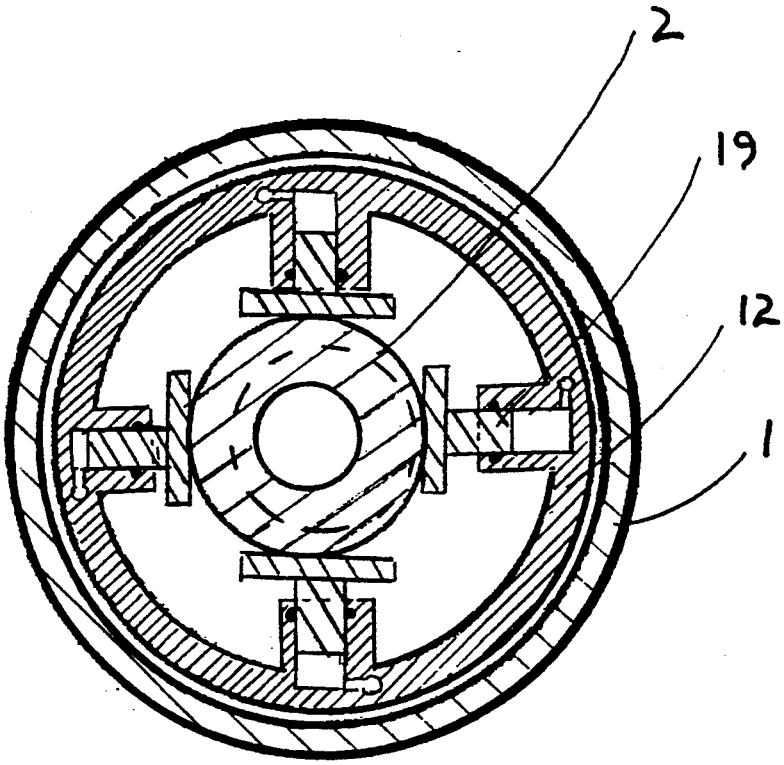
FIG. 7 is a transversal cross section of the nozzle head of FIG. 6

FIG. 7 shows the four pistons tangent in four points of the inclined nozzle tail surface.

FIG. 8 shows a nozzle tail equipped with a double wall rubber skirt in which the space between the two walls is divided into four quadrants (21) filled with hydraulic fluid. The upper edge of the skirt is attached to the vanes unit. With the nozzle in the tubing's axial position, all quadrants have equal volumes and the skirt is centered in the nozzle housing. If, however, fluid is transferred from one of the quadrants to its opposite, the skirt deformation produces a deviation of the nozzle tail from the axis. Each quadrant compartment is closed by a check valve (22). A proximity sensor in the nozzle cover opposite the nozzle tail may also be used to monitor the nozzle position through suitable electric connections to the sonde. As a preferred alternative, the proximity sensor may also be located in the nose of the sonde, if it operates by the sonar process. This eliminates the need for electric connections between sonde and nozzle assembly, but it requires some modifications of the commercially-available sondes, which are easily understood by those skilled in the design of this type of downhole instruments. Due to its simplicity and ruggedness, this is the preferred embodiment.

Figure 9:
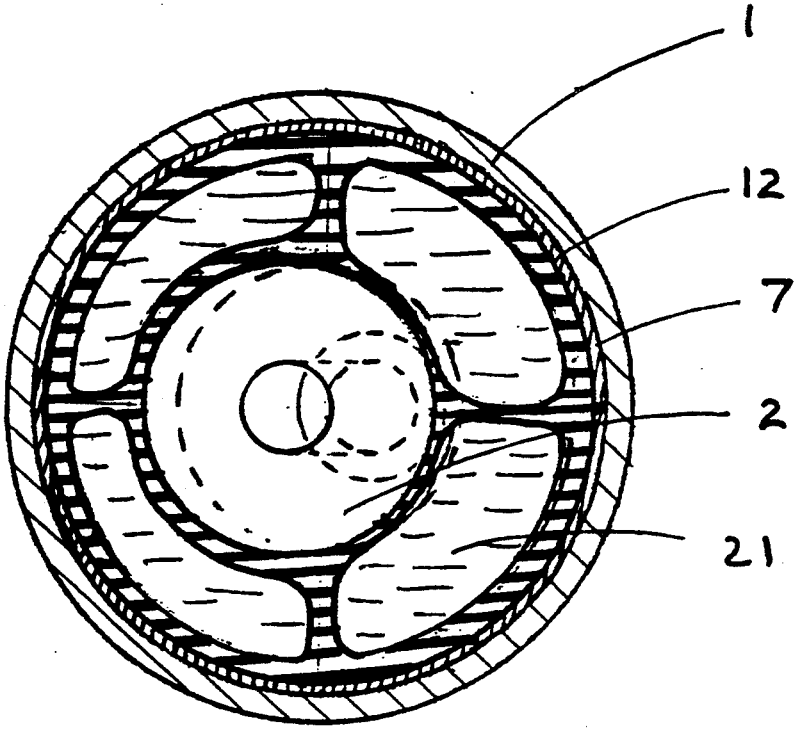
FIG. 9 is a transversal cross section of the nozzle head of FIG. 8

FIG. 9 shows a cross section of the double-wall skirt for a deviated position of the nozzle.

Figure 10:
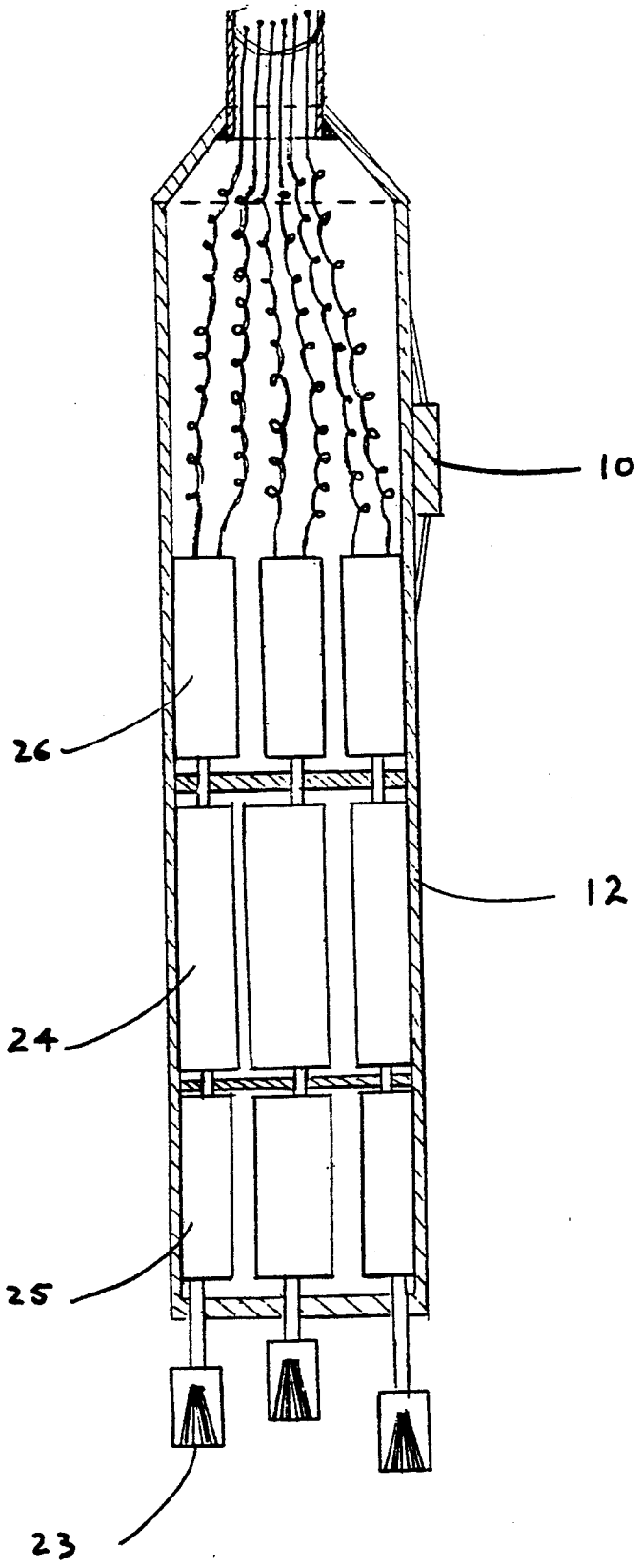
FIG. 10 is a block diagram of a wireline tool used to adjust the nozzle orientation in the nozzle head of FIG. 4.

FIG. 10 is the block diagram of the functional elements of the wireline tool used to adjust the nozzle head of FIG. 4. It consists of three female conical gears (23) actuated by three electric or hydraulic motors (24) through gear reducers (25) and turn counters (26). The tool is also equipped with a retractable pin (10) and an axial connector identical to that in the sonde nose. This tool is run in with an electric cable, if equipped with electric motors, and with a small-diameter hydraulic line if equipped with hydraulic motors. It is inserted in the reference groove in lieu of the sonde. The female conical gears are meshed with the male conical gears (15) of the nozzle assembly to sequentially turn each of the three adjustment screws (18) a prescribed number of turns in each direction, to change the nozzle orientation. These adjustments are made while water pressure is reduced at the surface, thus interrupting the jet-drilling progress, but maintaining circulation in the hole through the annulus around the tool. Once all adjustments have been made, the tool is disconnected from the nozzle assembly while water pressure is increased, thus resuming jet-drilling while the tool is pulled out and replaced by the orientation sonde.

Figure 11:
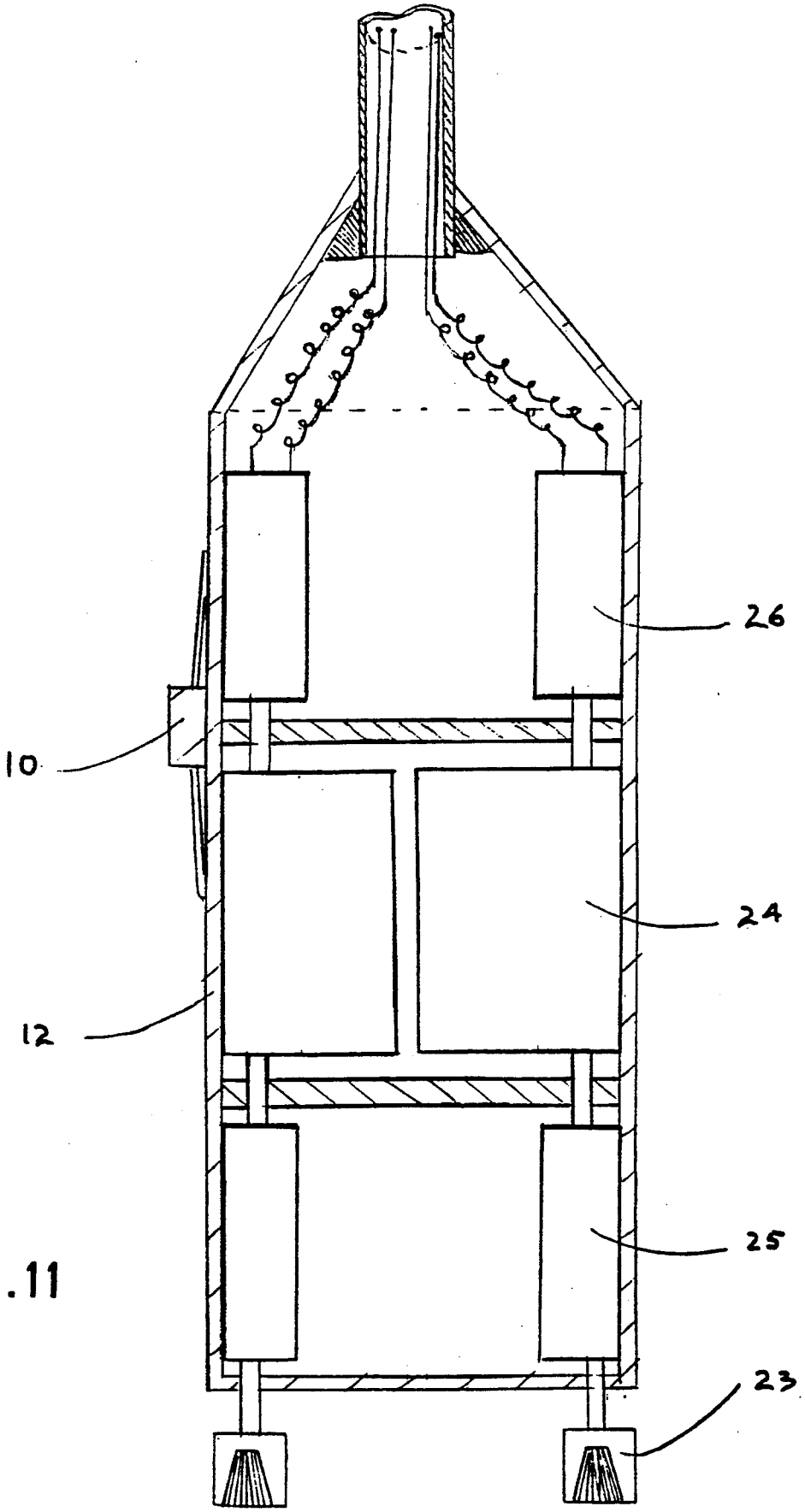
FIG. 11 is a block diagram of a wireline tool used to adjust the nozzle orientation in the nozzle head of FIG. 6.

FIG. 11 is the block diagram of the functional elements of the wireline tool used to adjust the nozzle head in FIG. 6. It is similar to that of FIG. 10, but the motors or actuators in the tool now drive the screw positioning the piston of each dual-cylinder positive-displacement pump (20). The adjustment procedure is the same as that for FIG. 10. As an alternative, each of the four hydraulic cylinders closed by pistons (19) pressing on the nozzle tail in FIG. 6 may be closed by a check valve, as hold-down device. In that case, the adjusting tool connects into the four check valves, opens them and establishes the flow connections with two motorized positive displacement pumps (20) now located in the tool itself, instead of being in the nozzle assembly.

Figure 12:
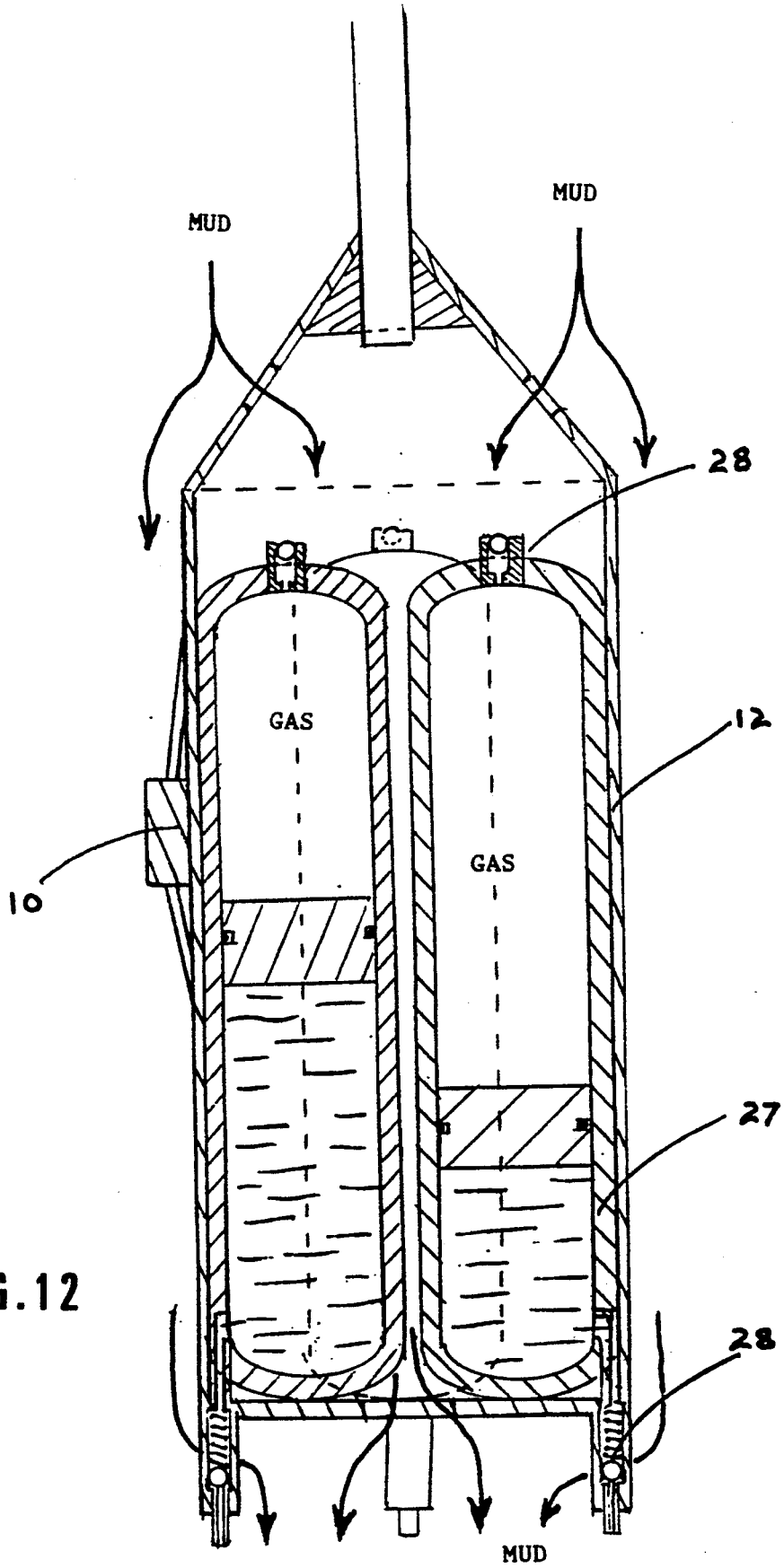
FIG. 12 is a block diagram of a wireline orientation tool used to adjust the nozzle orientation of FIG. 8.

FIG. 12 is the block diagram of the functional elements of the wireline tool used to adjust the nozzle head in FIG. 8. In that case, the four fluid-filled compartments in the double-wall skirt are closed with check valves (26). The tool connects directement each check valve (26) to another liquid-filled cylinder (27) pressurized by gas at the desired pressure and closed by a check valve (28). When the two check valves are connected to each other, they both open and transfer the pressure of the cylinder (27) to the corresponding quadrant compartment (21), thus modifying the liquid volumes in each compartment and, correspondingly, the position of the lower end of the skirt attached to the nozzle tail. The main advantage of this system is that it requires no energy transmission from the surface and the wireline may be a solid wire (slick line), which is cheaper than either an electric cable or a hydraulic line and which allows faster running of the tool in and out of the well.

Figure 13:
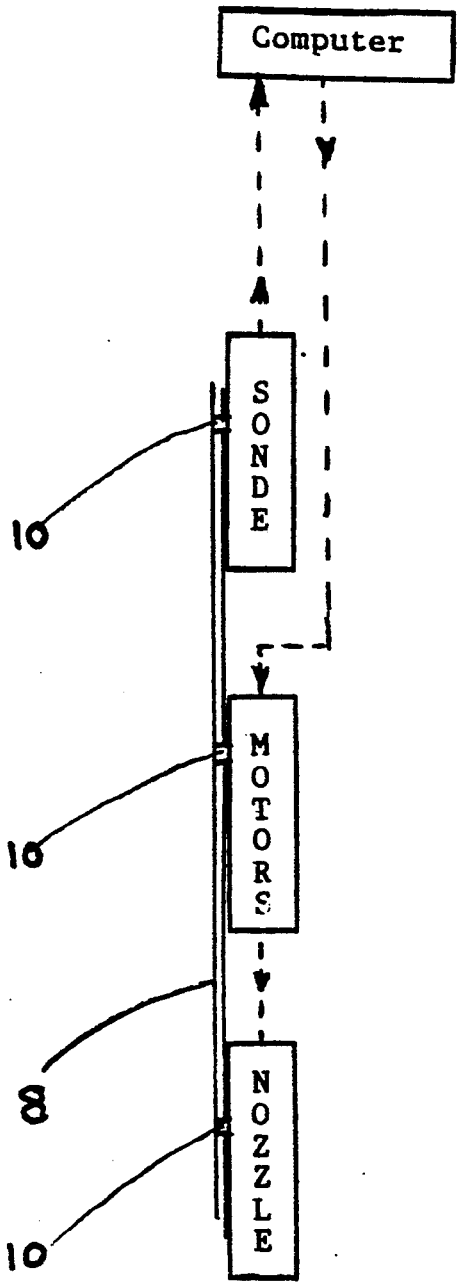
FIG. 13 is a block diagram of a servo system providing automatic and continuous adjustment of a nozzle head.

It will now be clear to those skilled in the art that, with the sonde operating as a continuous monitor of both the spatial orientation of the drilling head and of that of the nozzle, it is easy to design a servo system to adjust the nozzle orientation as a function of the spatial orientation of the drilling head. In FIG. 13, this adjustment is determined by a computer which may be located either in the sonde or at the surface. It is also clear that all three basic methods of adjustment of the nozzle orientation may be used in such a servo system and that the prime movers (motors or actuators) may be electrical or hydraulic or a combination thereof. The computer in the servo system may also be programmed to make the nozzle rotate at a very slow speed, to control the hole trajectory in the same way that a slow rotation of a conventional drill string and bottom hole assembly controls the course of a larger diameter deviated or horizontal well. The speed of rotation may be adjusted depending upon the characteristics of the formations penetrated by the drilling head. The operational flexibility of the coiled-tubing, jet-drilling system is then comparable with that of conventional methods, at a much reduced cost. Those skilled in the art will find that a large number of such combinations are possible without deviating from the basic principles of this invention.

It will also be evident to those skilled in the art that the same type of orientable nozzle, when used with liquid streams loaded with abrasive solid particles may cut lateral windows of precise shape into a casing. This requires that the successive nozzle orientations with respect to the reference groove be programmed so that the impact of the abrasive jet on the casing inner surface follows a specified path along the desired window's edge. This operation may be performed with the retrievable nozzle held within the lower end (drilling head) of a coiled tubing. For greater accuracy in the window shape, the coiled tubing is preferably held in a fixed deviated position by a whipstock. Because of the rapid wear of the nozzle material by the abrasive jet, it may be necessary to retrieve it periodically to the surface, for replacement with a new orientable nozzle, during the course of this window-cutting operation. The use of essentially the same tools and coiled tubing unit for both the window-cutting operation and the drainhole drilling operation provides significant cost savings.

After the drainhole has reached its target, the annulus between the coiled tubing and the jet-drilled hole may be gravel-packed by displacement of a sand slurry, as taught in U.S. patent application Ser. No. 814,585. The coiled tubing remains in the drainhole after retrieval of the nozzle assembly and sonde. Its upper part up to the casing window may be cemented using known techniques and, as shown in said Patent Application, the coiled tubing string may include a leak-tight male tubular connector or nipple which fits into a machined cavity within the kick-off whipstock used to guide the coiled tubing, so that a leak-tight connection is established just above the cemented branch connection with the casing. The coiled tubing opposite the gravel-packed section of the drainholes may then be slotted with the hydraulic cutting tool described in said Application. The upper part of the coiled tubing, above the cemented branch connection is then disconnected from the whipstock connection and reeled-in to the surface. This shows that all drilling and completion operations of the deviated drainhole may be performed without a drilling rig and may also be done through tubing, in minimum time, to cut down all rig costs.

Using various devices, as taught in the companion application Ser. No. 814,585, multiple drainholes may be drilled and completed from the same vertical well by this low-cost technique, which provides access into each medium-curvature drainhole for logging and cleaning tools. Such multiple drainholes may then be operated in sequential cyclic steam injection, as taught in U.S. Pat. No. 5,085,275, using the various downhole valve systems described in U.S. Pat. No. 5,052,482. It will be apparent to those skilled in the art that some of the flow channels in these downhole valve systems may also be combined with whipstocks for multiple drainholes, jet-drilled and completed with coiled tubings, for in further cost-cutting without deviating from the spirit of this novel technology.

I claim:

1. A jet-drilling assembly held in a cylindrical tubular housing, inserted in and coaxial with a coiled tubing drilling head, and comprising the following components and associated means, listed in ascending order from the assembly's lower end:

an orientable jet nozzle inserted and fitted into an axially-perforated dome cavity in said drilling head presenting a portion of a spherical inner surface, at the lower end of said tubing and centered on said tubing's axis, with said assembly's housing closely fitting inside said drilling head, a converging channel with a large opening surrounded by a deformable and movable seal, for conveying into said assembly's nozzle the main part of the tubing flow, a rotational flow device for imparting to the jet stream a rotation around its axis, prior to its passing through said opening, to maximize jet-drilling efficiency, equipment for positioning said assembly, its auxiliary tools and a known measuring sonde in a unique orientation relative to said tubing's axis and end, including a reference pin affixed to each of the respective housings of said assembly, tools and sonde and said pins sliding, in a close fit, into a reference groove cut in said tubing wall's inner surface, parallel to the axis of said tubing, associated means for the controlled operation and retrieval of said assembly and of its auxiliary tools and sonde, including:

1) means for the adjustment of said nozzle's orientation with respect to said pin and groove, by orientation-setting tools, 2) means for the measurement of the orientation of said groove relative to a universal frame of reference, with a known orientation-measuring sonde, 3) means for periodic retrieval to the surface of all components of said assembly, of said orientation-setting tools and devices and of said orientation-measuring sondes used in conjunction and compatible with said assembly, 4) means for connecting said assembly to the surface by various types of ombilicals inside said tubing, to transmit information relative to the spatial orientation of said tubing's reference groove when engaged by said reference pins.

2. A jet-drilling assembly according to claim 1 wherein said components and means consist of:

a) a tubular housing containing the assembly components b) a spatially-orientable jet nozzle axially drilled into a head presenting a portion of a spherical outer surface of same radius and center as said dome cavity, affixed to a tubular tail connected to the narrow end of a deformable skirt guiding a high-pressure liquid stream conveyed by said tubing to said nozzle, with said skirt's flared end firmly applied against the assembly's housing wall by the pressure of said liquid stream to form a deformable and movable seal, around a large opening, c) a vanes unit, in flow connection with the flared end of said skirt, equipped with fixed helical vanes whose cross-sections transverse to said housing axis are oriented along the outer portion of radii of said cylindrical housing, to impart a rotation of said liquid stream around its axis, after it enters into said housing from the upper part of the tubing, through multiple holes in the top shroud attached to the ombilical, and around the housings of said tools and sonde above said assembly, d) a multi-connector unit of a known type of wet connectors capable of operating under water and equipped with:

1) elements capable of mating the upper end of the assembly, with orientation devices in tools used to adjust, set and lock the spatial orientation of said nozzle with respect to said reference groove and pin, when the respective pins on the housings of the assembly and tools are engaged in said tubing reference groove, 2) elements capable of mating the upper ends of both the assembly housing and the tools' housing respectively with the lower end of the housing of a known sonde containing various sensors for determining the spatial orientation of said reference groove, in which its pin is engaged, by measuring the angles the tubing groove makes with respect to the vertical and to a reference azimuthal direction.

3) elements capable of mating the upper ends of respectively the assembly housing, the tools' housing, the sonde's housing latches in the top shroud attached to the stress-resistant link in the ombilical, to allow their respective retrieval, individually or in combination, when the ombilical is reeled-in, 4) elements capable of mating the upper ends respectively of the tools' housing and of the sonde's housing with terminals for data transmission in the top shroud linked to data transmission cables in the ombilical, used to transmit respectively power and information from the surface to the orientation-setting devices, and information from sensors in the orientation-measuring sonde to the surface, when a reference pin in said shroud and any housing pin are aligned by being engaged in the common straight reference groove in the tubing wall.

3. A jet-drilling assembly according to claim 2, wherein the wet connector unit is mated to a retrievable tool guided into said reference groove by a pin affixed to the tool's housing which contains said orientation devices, periodically actuated from the surface during the re-adjustment, setting and locking of any new spatial orientation of said nozzle with respect to the pin affixed to the housing of said assembly.

4. A jet-drilling assembly according to claim 2 wherein the wet connector unit is mated to a known retrievable sonde guided into said reference groove by a pin affixed to the sonde's housing, which contains sensors of the sonde's orientation with respect to the fixed reference directions and means for the transmission to the surface of orientation measurements through said ombilical.

5. A jet-drilling assembly according to claims 2 wherein the wet connector unit is mated to both a retrievable tool and a retrievable sonde, so that the orientation measurements from said sonde can be used to automatically re-adjust the position of the said orientation devices by means of a computer.

6. A jet-drilling assembly according to claim 2 wherein the jet nozzle orientation with respect to said reference pin is determined by at least three pusher rods actuated by non-reversible screws and pressing against the transverse diametrical plane of the spherical surface of said nozzle head, so that the axis of said nozzle is at a prescribed small angle from the axis of said tubing end and firmly locked into that position.

7. A jet-drilling assembly according to claim 2 wherein the jet nozzle orientation with respect to said reference pin is determined by at least three hydraulic pistons applying a lateral pressure against the outer surface of revolution of said nozzle tail, so that the axis of said nozzle is at a prescribed small angle from the axis of said tubing end and firmly locked into that position.

8. A jet-drilling assembly according to claim 2 wherein all adjustments and settings of the said orientation devices are made at the surface after retrieval of said assembly by means of said ombilical and prior to its return downhole into the reference groove of said tubing.

9. A jet-drilling assembly according to claim 2 wherein said deformable skirt has a double wall and the space between these walls is divided into at least four liquid-filled compartments, each one at a different pressure and closed by a check valve, affixed to the housing so that any axial rotation of the flared end of the skirt in the housing is prevented while the narrow end of the skirt is pushed away from the axis of said tubing in a lateral direction by the compartments filled with liquid at the highest pressures, thus pushing the nozzle tail in two intersecting lateral directions, setting the nozzle at a prescribed small angle from the axis of said tubing and locking it in that position.

10. A jet-drilling assembly according to claim 6 wherein the screw-type orientation devices are actuated downhole by retrievable tools containing motors, the rotation of which is controlled from the surface through said ombilical, based on the sensor data previously transmitted to the surface by the sonde.

11. A jet-drilling assembly according to claims 7 wherein the hydraulic piston-type orientation devices are actuated downhole by retrievable tools containing positive displacement pumps controlled from the surface through said ombilical, based on the sensor data previously transmitted to the surface by the sonde.

12. A jet-drilling assembly according to claims 8 wherein the liquid-filled skirt compartments are individually pressurized downhole by means of a retrievable tool containing liquid tanks pressurized by gas cylinders pre-set at the prescribed pressures based on the sensor data previously transmitted to the surface by the sonde.

13. A jet-drilling assembly according to claim 5 wherein the sensor data are fed into a computer which automatically controls the downhole adjustment of screw-type orientation devices.

14. A jet-drilling assembly according to claim 5 wherein the sensor data are fed into a computer which automatically controls the downhole adjustment of hydraulic piston-type orientation devices.

15. A jet-drilling assembly according to claim 5 wherein the sensor data are fed into a computer which automatically controls the adjustment downhole of the skirt compartments pressures by means of hydraulic pumps.

16. A jet-drilling assembly according to claim 1 wherein the ombilical to which it is connected contains an electric cable.

17. A jet-drilling assembly according to claim 1 wherein the ombilical to which it is connected contains a small-diameter coiled tubing used as hydraulic line.

18. A jet-drilling assembly according to claim 1 wherein the ombilical to which it is connected is a slick-line cable.

19. A jet-drilling assembly according to claim 5 wherein the sonde sensing the spatial orientation of the reference groove also determines the spatial orientation of the nozzle tail, thus providing a direct feed-back of the nozzle orientation adjustments, independent of any errors in motor rotation or pressure setting.

20. A jet-drilling assembly according to claim 2 wherein a slip stream of high pressure liquid is conveyed from the shroud through shallow grooves into the interfacial space between the respective spherical surfaces of the head and of the dome cavity of the tubing, so as to provide pressure balance and lubrication to facilitate all nozzle orientation adjustments and nozzle assembly retrievals.

21. A jet-drilling assembly according to claim 2 wherein the liquid stream is loaded with abrasive solid particles and oriented into successive positions so that its impact against the inner surface of a cemented well casing results in the cutting of a window of prescribed shape through which the coiled tubing, guided by a whipstock, is inserted in a relatively close fit to facilitate cementation of the coiled tubing, used as liner, at a later date, after retrieval of the assembly, tools and ombilicals.

22. A jet drilling assembly according to claim 1 wherein the ombilical to which it is connected is a multi-strand cable comprising:

a) a stress-resistant armour, withstanding the tension applied at ground level to pull-out and bring to the surface said assembly or its components.

b) insulated electrically-conductive wires, carrying electric power from the surface to said assembly or to its components, c) electrical or fiber optic cable means for accurately transmitting multiple information signals to and from said assembly regarding the spatial orientation of said assembly and of said orientable jet nozzle.

* * * * *